US007794366B2

(12) United States Patent
Smith et al.

(10) Patent No.: US 7,794,366 B2
(45) Date of Patent: Sep. 14, 2010

(54) VERTICALLY ADJUSTABLE STILTS

(76) Inventors: Kevin D. Smith, 715 Raleigh Creek Dr., Cridersville, OH (US) 45806; Patrick Chaney, 1055 Perry Chapel Rd., Lima, OH (US) 45804

( * ) Notice: Subject to any disclaimer, the term of this patent is extended or adjusted under 35 U.S.C. 154(b) by 0 days.

(21) Appl. No.: 12/547,372

(22) Filed: Aug. 25, 2009

(65) Prior Publication Data

US 2010/0048361 A1 Feb. 25, 2010

Related U.S. Application Data

(60) Provisional application No. 61/091,628, filed on Aug. 25, 2008.

(51) Int. Cl.
*A63B 21/08* (2006.01)

(52) U.S. Cl. ..... 482/75; 482/76

(58) Field of Classification Search ..... 482/75; 248/354.1; 267/64.28; 623/28
See application file for complete search history.

(56) References Cited

U.S. PATENT DOCUMENTS 2,351,145 A * 6/1944 Pearson ..... 623/28
2,835,493 A * 5/1958 Skaggs et al. ..... 482/75
3,058,120 A * 10/1962 Smith et al. ..... 623/28
3,065,962 A * 11/1962 Hoffmeister ..... 482/75
3,660,920 A * 5/1972 Spina ..... 482/75
4,415,063 A 11/1983 Hutchison
4,569,516 A 2/1986 Masterson
4,632,371 A * 12/1986 Wirges et al. ..... 267/64.28
5,509,874 A 4/1996 Shih
6,032,914 A * 3/2000 Bastida ..... 248/354.1

* cited by examiner

*Primary Examiner*—Jerome Donnelly
(74) *Attorney, Agent, or Firm*—MacMillan, Sobanski & Todd, LLC

(57) ABSTRACT

A height adjustable stilt comprises a base and an extensible leg having a lower end secured to the base and an upper end. A foot support extends laterally from the extensible leg and is supported by the extensible leg. The foot support is height adjustable relative to the base as the extensible leg is extended or retracted. A height adjuster is configured to selectively extend the foot support relative to the base and configured to selectively fix the position of the foot support relative to the base.

19 Claims, 11 Drawing Sheets

VERTICALLY ADJUSTABLE STILTS

CROSS-REFERENCE TO RELATED APPLICATIONS

This application claims the benefit of U.S. Provisional Application No. 61/091,628, filed Aug. 25, 2008, the disclosure of which is incorporated herein by reference.

BACKGROUND OF THE INVENTION

This invention relates in general to height adjustable walking mechanisms, such as stilts, and in particular to height adjustable stilts having an improved ingress and egress height capability.

Stilt mechanisms are used to provide a vertically elevated support platform for each foot of a user. The stilts allow ambulatory movement in a vertically elevated position. Some stilts, especially stilts used in the building trades, facilitate access to overhead objects, such as ceilings, gable peaks and the like. Some stilts provide height adjustment capabilities.

It would be desirable to provide an improved stilt mechanism, especially for use in a construction environment.

SUMMARY OF THE INVENTION

This invention relates to a height adjustable stilt that comprises a base and an extensible leg. The extensible leg has a lower end secured to the base and an upper end. A foot support extends laterally from the extensible leg and is supported by the leg. The foot support is height adjustable relative to the base as the leg is extended or retracted. A height adjuster is configured to selectively extend the foot support relative to the base and configured to selectively fix the position of the foot support relative to the base.

This invention further relates to a height adjustable stilt that comprises an outer tube having an open telescoping end and a foot platform attached adjacent to the open telescoping end. An inner tube is telescopically received within the outer tube at the open telescoping end and a base plate connected to the inner tube. A gas spring, having a cylinder and a piston, is disposed inside the telescopically engaged inner and outer tubes.

This invention further relates to a height adjustable stilt that comprises an inner tube that is telescopically received within an outer tube. A base plate is connected to one of the inner and the outer tube and a foot support connected to the other of the inner and the outer tube. A height adjuster is operatively connected to a release lever. The height adjuster selectively allows the foot support to extend relative to the base plate and to be compressed toward the base when the release lever is actuated. The height adjuster is further configured to fix the position of the foot support relative to the base plate when the release lever is released.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
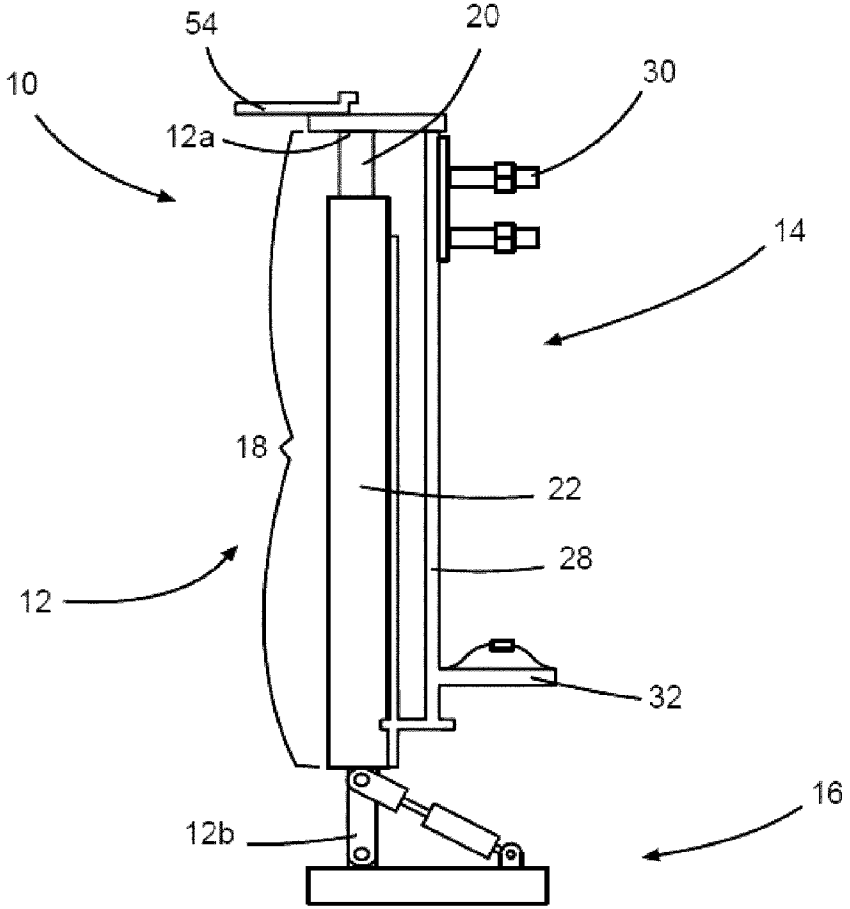
FIG. 1 is a front elevational view of a stilt mechanism in a collapsed position.

Height adjustable walking mechanisms, such as stilts, are used in the construction industry to vertically elevate a tradesman to be in close proximity to overhead objects. As a consequence, these stilts need to provide a hands-free, stable footing for a user, such as, for example a drywaller, an electrician, or a painter. The stilts need to allow the tradesman not only use of his hands while in the elevated position, but also an ambulatory freedom of movement. In construction stilts, typically, the foot platform of each stilt is positioned above and connected to at least one leg structure. The leg structure, or leg support, in turn, is positioned over and connected to a base. This configuration orients the leg support to be principally loaded in compression, similar to a load bearing column, with the compressive line of force acting through the support. The compressive load orientation allows the weight of the user to be transferred through the leg to the base without a substantial static bending moment. Such a static bending moment would cause the stilts to fall over absent a substantial corrective force from the user, thus reducing stability and usefulness.

Some conventional stilts derive stability by orienting the foot platform in line with one or more leg supports and the base. The foot platform is positioned directly over the leg support and the base. When stilt components are arranged inline, the collapsed or minimum height of the foot platform relative to the base may be of sufficient distance to make ingress and egress more difficult. Furthermore, once the user is secured to the stilts, the minimum stilt height, established by the collapsed leg height, may hamper efforts to access objects on the ground (at or near the base).

Other stilt structures may provide an offset orientation between the footrest and the point of contact of the stilt with the ground. In the stilt structures where the foot platform is offset from the leg support, the user may need to provide necessary reaction loads to counteract the bending moment about the base. Such a reaction may be effected by providing hand holds or by positioning an extending portion of the stilt against the user's leg. The resulting bending moment of the user's weight applied to the stilt is counteracted by the user's leg. This user-provided reaction load, however, may result in awkwardness, fatigue, pressure points and abrasions, or injuries in the event of a slip-and-fall situation.

Stilts having an inline oriented foot support platform, vertically extending leg, and base typically have a significant minimum collapsed height. The minimum collapsed height often requires the user to transition from an initial standing or seated position to a substantially elevated standing position, after putting on the stilts. Many of these stilts also have height adjustment mechanisms that are awkward to alter once secured to the user. Such adjustment mechanisms may require unfastening extendable components, extending the stilts to the desired height, and refastening the attachment bolts. Thus, stilts having reduced collapsed footplate heights and improved height extension capabilities would be desirable.

Figure 2:
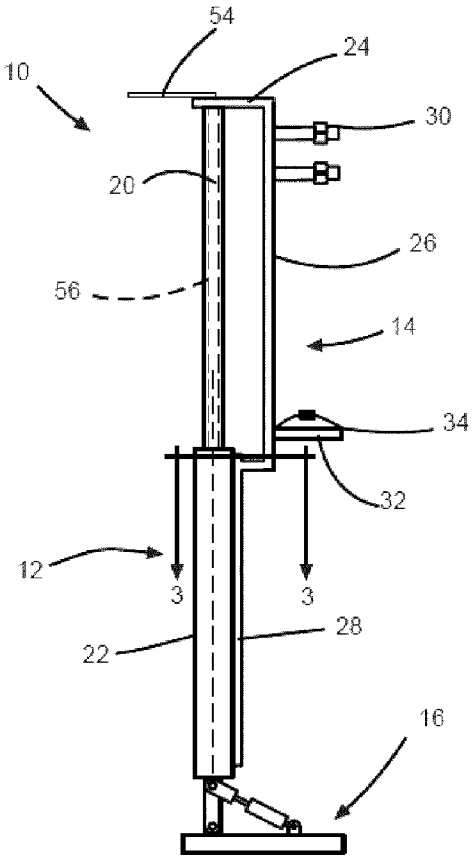
FIG. 2 is a front elevational view of the stilt mechanism of FIG. 1 in an extended position.

Referring now to the drawings, there is illustrated in FIGS. 1 and 2 a stilt, shown generally at 10, that is one of a pair of stilts. The pair of stilts may include two identical stilts or two complementary, mirror image stilts for right and left sides. The stilt 10 includes a leg support, shown generally at 12, a user mounting assembly, shown generally at 14, and a base assembly, shown generally at 16. The leg support 12 includes an upper end 12*a*, a lower end 12*b*, and an adjustable lift unit 18. In one embodiment, the adjustable lift unit 18 includes a hollow, inner tube 20, or alternatively a solid rod, telescopically engaged within an outer tube 22. A plurality of intermediate tubes, such as intermediate tube 21 shown in FIG. 3, may be telescopically disposed between the inner tube 20 and the outer tube 22 to provide an extended height adjustment capability. The inner tube 20 engages a portion of the user mounting assembly 14, and the outer tube 22 engages a portion of the base assembly 16. Alternatively, the outer tube 22 may engage the user mounting assembly 14 and the inner tube 20 may engage the base assembly 16.

Figure 3:
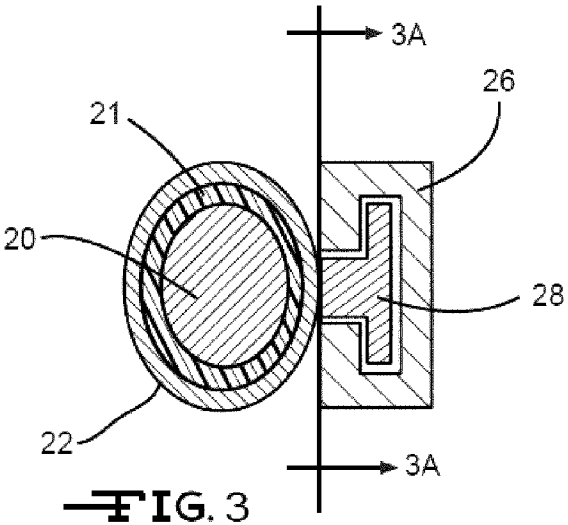
FIG. 3 is a cross sectional view, taken along line 3-3, of the stilt mechanism of FIG. 2.

The leg support 12 further includes an upper mounting plate 24 that engages the inner tube 20 and a portion of the user mounting assembly 14. Though shown in FIGS. 1 and 2 as being mounted on the end of the inner tube 20, the mounting plate 24 may be mounted on any suitable portion of the inner tube 20. The mounting plate 24 engages a guide bar connector 26. The guide bar connector 26 slides relative to a guide bar 28 that is attached the outer surface of the outer tube 22. The guide bar 28 is shown in FIG. 3 having a "T"-shape that engages a corresponding "T" shaped slot or track in the guide bar connector 26 for relative sliding movement therebetween. While shown as a "T"-shaped structure, the guide bar 28 and connector 26 can have any complimentary shape capable of relative sliding movement while preventing relative rotational movement. The shape of the guide bar 28 prevents the inner tube 20 and the user mounting assembly 14 from rotating or spinning relative to the outer tube 22 and the base assembly 16. Alternatively, the inner tube 20 and the outer tube 22 may be shaped to provide sliding and non-rotating movement. For example, FIG. 3 shows the inner tube 20 and the outer tube 22 having an oval cross section, however, other cross sections may be used such as square, rectangular, triangular, hexagonal, oval, "lemon" shaped, and the like.

A leg support grip 30 is mounted on the upper end of the guide bar connector 26. The leg support grip 30 may be an arcuately shaped panel, with or without padding, that rests against a portion of the user's leg (not shown), though such a panel structure is not required. The leg support grip 30 may include a strap, buckle, hook and loop fastener, laces, or other suitable means to attach the upper part of the user mounting assembly 14 to the user. The lower portion of the user mounting assembly 14 includes a foot support or platform 32 secured thereto. The foot platform 32 may be any structure that supports a user's foot and/or footwear. The foot platform 32 may include a securing strap 34 to retain the user's foot onto the platform 32. The securing strap may be a flexible strap or a rigid hoop that allows insertion of the user's foot or footwear. Additionally, the foot platform 32 may also include a toe clip 36 and/or a heel stop 38, as shown in FIGS. 4 and 5, in order to position the foot on the platform 32, though such positioning structures are not required.

In an alternative embodiment, the foot support 32 may be connected to the inner tube 20 which is telescopically received in the outer tube 22. The outer tube 22 is connected to the base assembly 16 and further includes a slot or opening that allows the inner tube 20 to carry the foot support 32 in close proximity to the base assembly 16. The outer tube 22 may be configured similarly to the guide bar 28 having an open side. The foot support 32 may be positioned on the outside of the outer tube and move within the slot. The inner tube may be telescopically supported within the outer tube by the height adjuster 56.

As shown in FIGS. 1, 2, 4, and 5 the leg support 12 is connected to the base assembly 16. The base assembly 16 includes a base plate 40 that is configured to support the stilt and the user's weight on a surface, such as the ground, floor, stairs, and the like. The base plate 40 may be any desired shape, such as, for example, square, rectangular, round, oval, foot-shaped, and the like. The base plate may be made from any material, such as, for example, steel, aluminum, plastic, fiberglass, wood, and the like. In one embodiment, the base plate 40 includes an optional sole pad 42 disposed between the base plate 40 and the ground. The sole pad 42 may be a flexible polymer layer having a deflection characteristic similar to the skin and flesh of a human foot sole. The flexible nature of the sole pad 42 provides damping to minimize shock loading as the user walks with the stilts attached. Additionally, if the user steps on an object, such as an extension cord, nail, bolt, dowel pin, and the like, the sole pad 42 will deflect around the object to allow the remaining surface area to contact the firm area adjacent to the object. This ability of the sole pad 42 to deflect around the object provides a secure, supported footing to prevent slipping.

Figure 4:
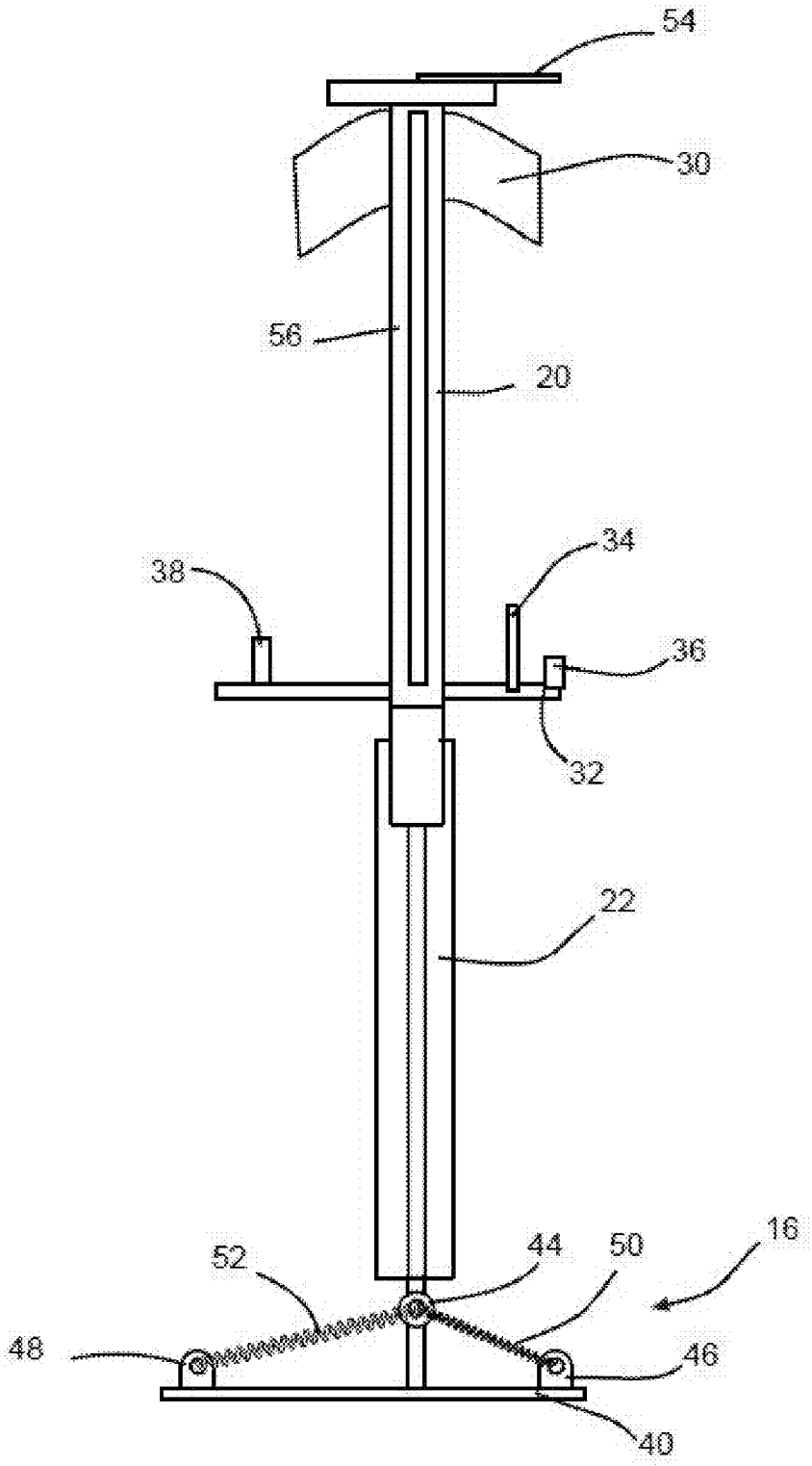
FIG. 4 is a side elevational view of the stilt mechanism of FIG. 2.
Figure 5:
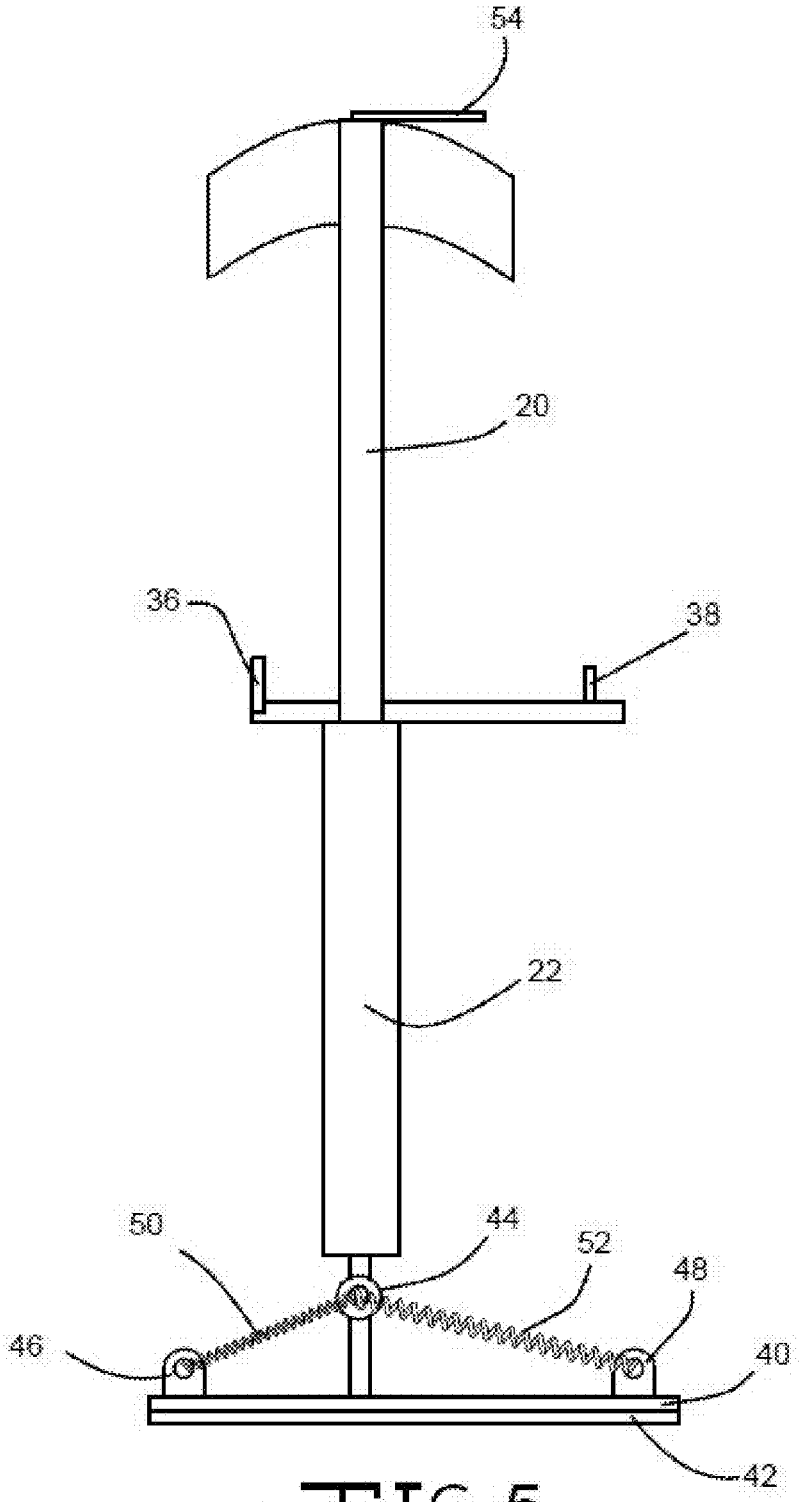
FIG. 5 is an opposite side elevational view of the stilt mechanism of FIG. 4

The base assembly 16 further includes a main pivot 44 that facilitates a flexible movement of the base plate 40 relative to the outer tube 22, as shown in FIGS. 4 and 5. The base assembly 16 may further include a heel pivot 46 and a toe pivot 48. In the embodiment shown in FIGS. 4 and 5, a rearward resilient member or spring 50 is disposed between the main pivot 44 and the heal pivot 46. A forward resilient member or spring 52 is disposed between the main pivot 44 and the toe pivot 48. The rearward and forward springs 50 and 52, respectively, bias the base plate 46 in a substantially perpendicular orientation relative to the outer tube, though other biased orientations may be used if so desired. The rearward and forward springs 50 and 52, respectively, are illustrated as coil springs, though other resilient structures such as, for example, hair pin springs, leaf springs, elastomeric springs, and the like may be used if so desired. When the user walks on the stilt 10, the main pivot 44 allows deflection of the base plate 46 relative to the outer tube 22 in much the same manner as an ankle allows a foot to move relative to a leg. The heel and toe pivots 46 and 48, respectively, allow the rearward and forward springs 50 and 52, respectively, to compress without imparting a substantial buckling deflection component thereto.

Referring again to FIG. 1, the lift unit 18 of the stilt 10 is illustrated in the collapsed, or compressed, position and in the extended position in FIG. 2. When the stilt 10 is in the collapsed position, the distance between the foot platform 32 and the base plate 40 is less than the collapsed height of the lift unit 18. In the illustrated embodiment, the lift unit 18 includes a release lever 54 that selectively engages or releases a height adjustment mechanism or height adjuster 56 allowing the inner tube 20 to be positioned relative to the outer tube 22. In the pneumatically actuated embodiment of the stilt 10, the height adjuster 56 is a gas spring and cylinder structure, either contained in a separate cylinder within the inner tube 20 or contained within a cavity in the inner tube 20. The release lever 54, when actuated, allows gas, contained within the inner tube 20, to be moved within the gas spring 56 or exhausted from a portion of the gas spring 56 by the weight of the user. This allows the stilt 10 to be compressed to the collapsed position for reduced height facilitating user access to objects on the ground or easing putting on the stilts. The gas spring 56 is configured to adjust the elevation of the foot platform 32 relative to the base 16 while the stilts 10 are in use. The release lever 54 is positioned so that the user can release the selectively fixed position of the gas spring 56 to adjust the height of the stilts while in use.

Figure 3B:
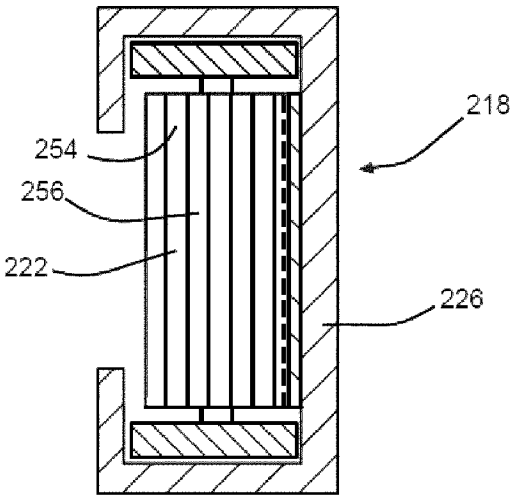
FIG. 3B is a cross sectional view, taken along line 3B-3B, of a portion of the stilt mechanism of FIG. 3A.
Figure 3A:
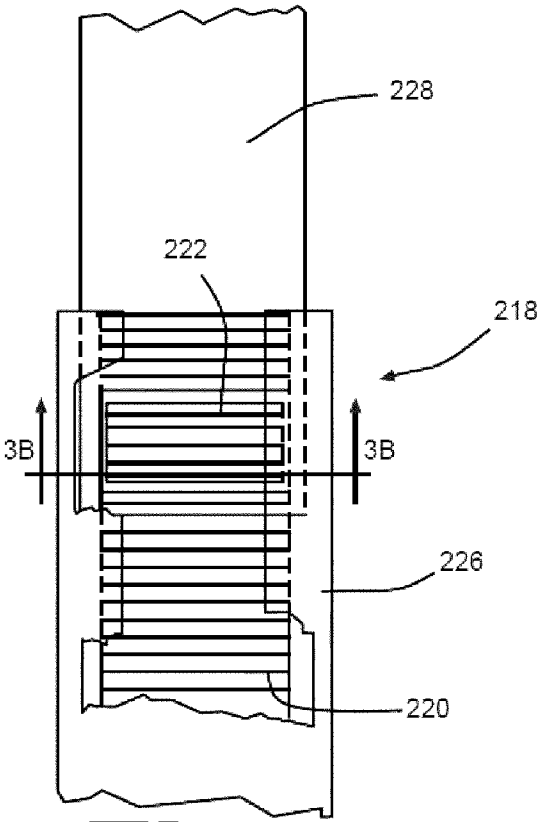
FIG. 3A is an enlarged view of a portion of another embodiment of a stilt mechanism.

In another embodiment shown in FIGS. 3A and 3B, an adjustable lift unit 218 may include a rack 220 and pinion 222 arrangement. FIG. 3A illustrates a different embodiment to that of FIG. 3 but is a view taken from the vantage point indicated by line 3A-3A in the previous embodiment shown in FIG. 3. The rack 220 may be mounted to either an outer support 226 or an inner support 228, if so desired. The rack 220 is shown in FIGS. 3A and 3B mounted to the outer support 226. The pinion 222 is shown engaged to the inner support 228. The rack 220 has a plurality of alternating projecting teeth 250 and recessed spaces 252 disposed along the length. Similarly, the pinion 222 has a plurality of alternating projecting teeth 254 and recessed spaces 256 disposed about the circumference. In operation, the teeth 254 of the pinion 222 engage the spaces 252 of the rack 220. The pinion 222 rolls along the length of the rack 220 to accommodate various height adjustment positions. In one embodiment, the pinion 222 may be driven by an electric motor (not shown) to allow powered operation in raising and lowering the stilt 10. In another embodiment, the pinion 222 may be a motorized driving element having the teeth 254 positioned along a rotatable armature and the center pinion shaft functioning as a stator element. Alternatively, the rack and pinion arrangement may function as an alternative guide bar connector 26 and guide bar 28. The rack 220 and the pinion 222 may provide a relative locking condition therebetween to function as a safety catch assembly, if desired. A singular tooth (not shown) may be selectively disposed into the meshed rack and pinion teeth to prevent relative movement.

Figure 7:
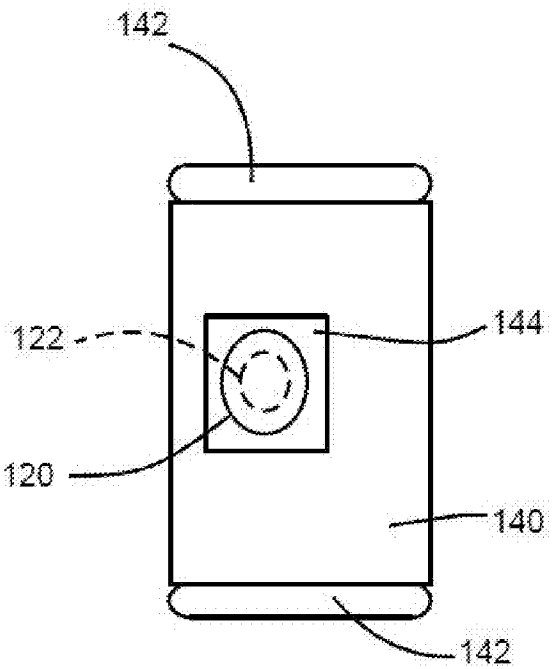
FIG. 7 is a top view, taken along arrow 7, of the stilt mechanism of FIG. 6.
Figure 6:
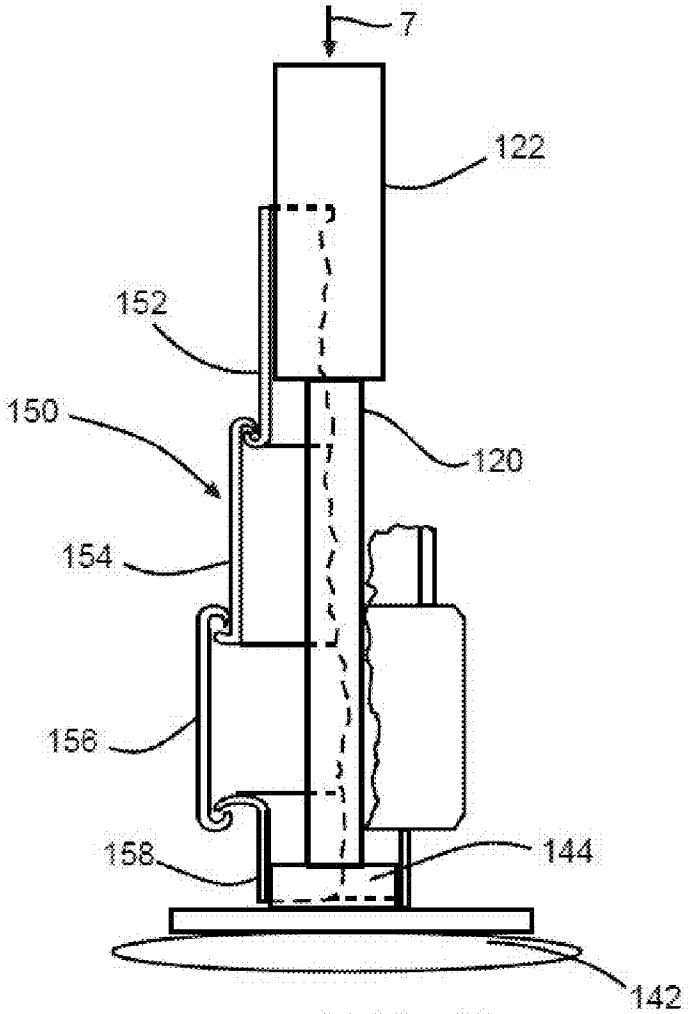
FIG. 6 is an elevational view of a portion of another embodiment of a stilt mechanism.

In an alternative embodiment, a base plate 140 may be fixed relative to an inner tube 120 and an outer tube 122, as shown in FIGS. 6 and 7. The base plate 140 may be directly connected to the inner tube 120 or may be mounted to a mounting pedestal 144 disposed therebetween. Additionally, a telescoping cover assembly 150 may be disposed about the inner and outer tubes 120 and 122, respectively. The telescoping cover 150 includes a first telescoping section 152 engaging the outer tube 122. A portion of the first telescoping section 152 slides inside a second or intermediate telescoping section 154. There may be provided as many intermediate sections 154 as desired. The intermediate telescoping section 154 engages a final telescoping section 156. The final telescoping section 156 engages a mounting base 158 that is engaged to the base plate 140 or the pedestal 144, if so desired.

Figure 8:
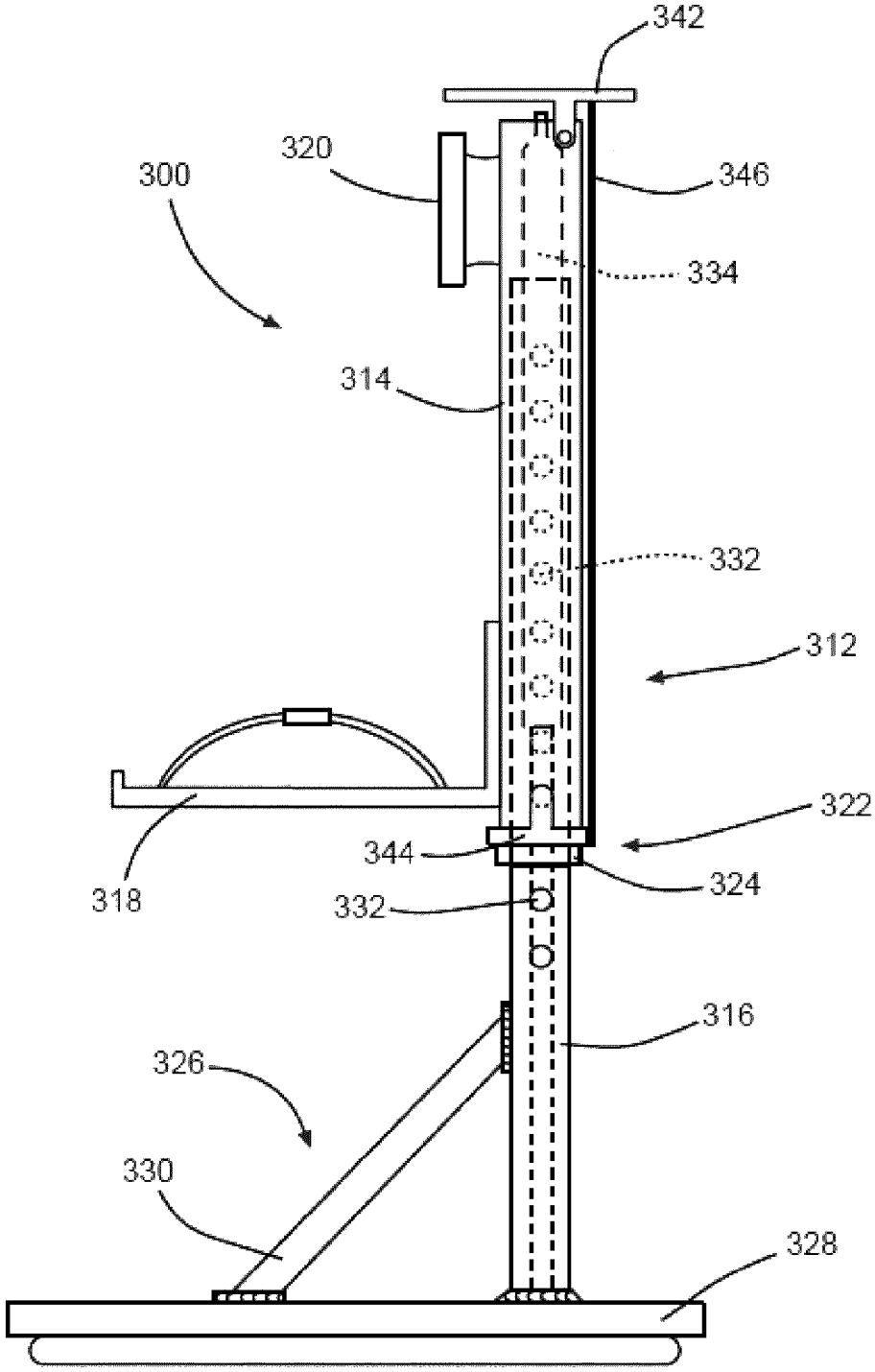
FIG. 8 is a front elevational view of another embodiment of a stilt mechanism in a near-collapsed position.
Figure 9:
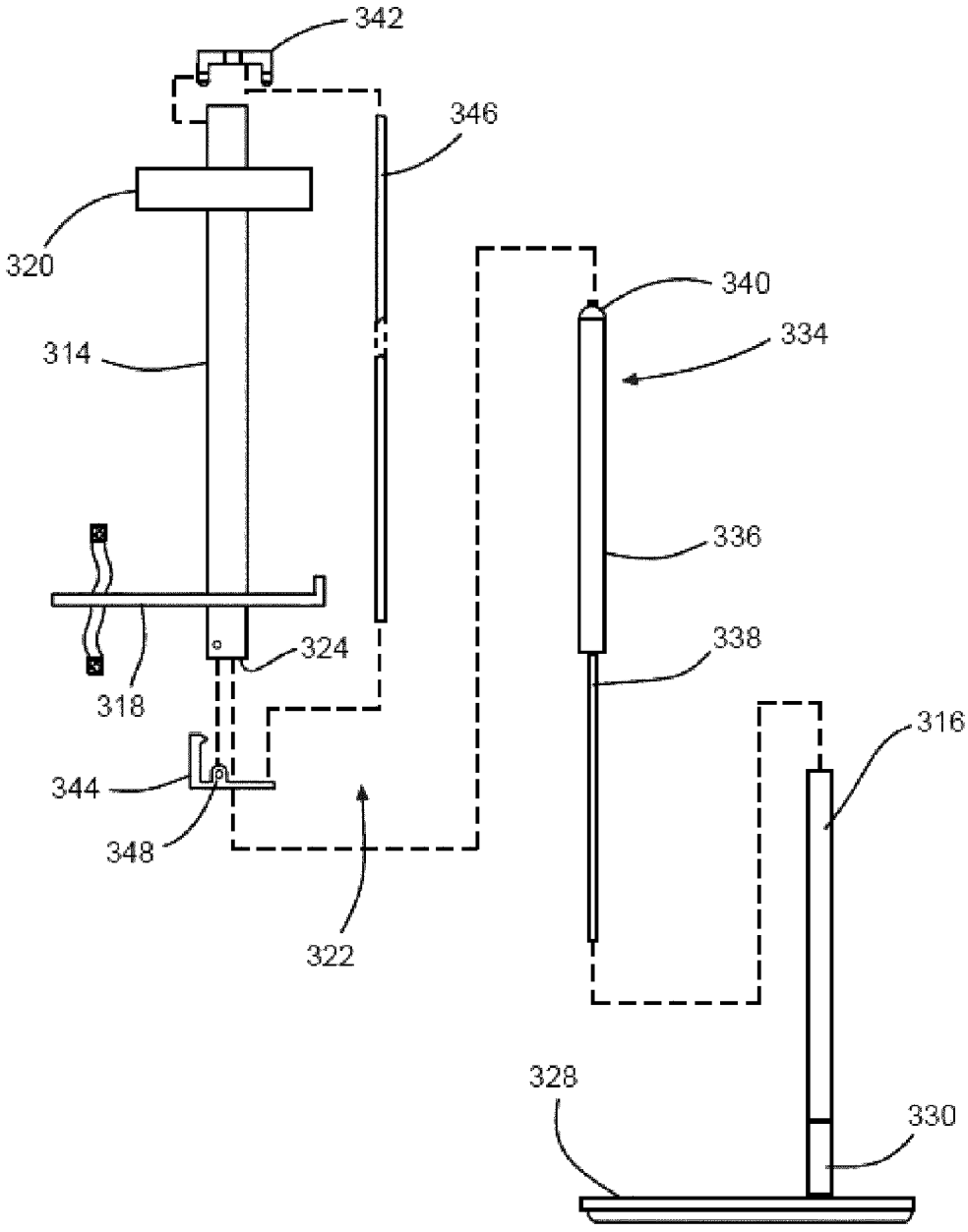
FIG. 9 is an exploded view of the stilt mechanism of FIG. 8.

Referring now to FIGS. 8 and 9, there is illustrated another embodiment of a stilt, shown generally at 300. The stilt 300 includes an extensible leg support, shown generally at 312. The leg support 312 includes a pair of cooperating, telescoping tubes, illustrated as an outer tube 314 and inner tube 316. The leg support 312 may include other intermediate telescoping tubes, if desired. The outer tube 314 includes a footplate or foot platform 318 and a leg support grip 320, similar to the foot platform 32 and the leg support grip 30 described above. The outer tube 314 is illustrated having a safety catch assembly 322 mounted near an open, telescoping end 324 of the outer tube 314. The open, telescoping end 324 of the outer tube 314 is configured to receive a portion of the inner tube 316 for relative movement therewith. In one embodiment, the safety catch assembly 322 is a structure to prevent relative movement of the outer tube 314 relative to the inner tube 316. The inner tube 316 includes a base assembly, shown generally at 326. The base assembly 326, shown in FIGS. 8 and 9, includes a base plate 328 and a fixed support bar 330. The inner tube 316 further includes a plurality of safety catch apertures 332 formed therethrough.

The leg support 312 further includes a gas spring assembly 334, shown inside the engaged outer and inner tubes 314 and 316. The gas spring assembly 334 includes a cylinder 336 and a piston 338. The gas spring 334 is connected to the outer tube 314 at one end of the cylinder 336, such as the closed end that includes a release valve 340. The piston 338 is connected to one of the inner tube 314 or the base plate 328 at the opposite end of the gas spring 334. The piston 338 may have a plunger end (not shown) that slides within the cylinder 336, though such a configuration is not required. The gas spring assembly 334 is actuated by the release valve 340 to allow selective telescoping movement of the piston 338 relative to the cylinder 336. The release valve 340 allows air, or any other gaseous or liquid fluid, to be admitted or exhausted from the cylinder 336 thus allowing movement of the piston 338 within the cylinder 336. The gas spring 334 may exhaust fluid from an upper chamber of the cylinder 336 to a lower chamber of the cylinder. Alternatively, the gas spring 334 may exhaust and admit air externally from the cylinder 336 to effect movement of the piston 338. The release valve 340 is opened by actuating a release lever 342, similar to the release lever 54 described above. The release lever 342 also actuates the safety catch assembly 322, which includes a latch 344 and a latch rod 346. The release lever 342 is illustrated as a pivotable handle structure, though such is not required. The release lever 342 may be configured as any actuation device such as, for example, a button, a knob, a switch, and the like. In one embodiment, the gas spring 334 is the primary structure to prevent movement of the outer tube 314 relative to the inner tube 316 when locked in position by the release valve 340. In such a case, the safety catch assembly 322 is then a secondary structure to prevent relative movement of the outer tube relative to the inner tube. The safety catch assembly 322 is configured to prevent relative movement of the foot plate 318 relative to the base plate 328 if the gas spring 334 or the release valve 340 cease to properly function or become inoperative.

Figure 10B:
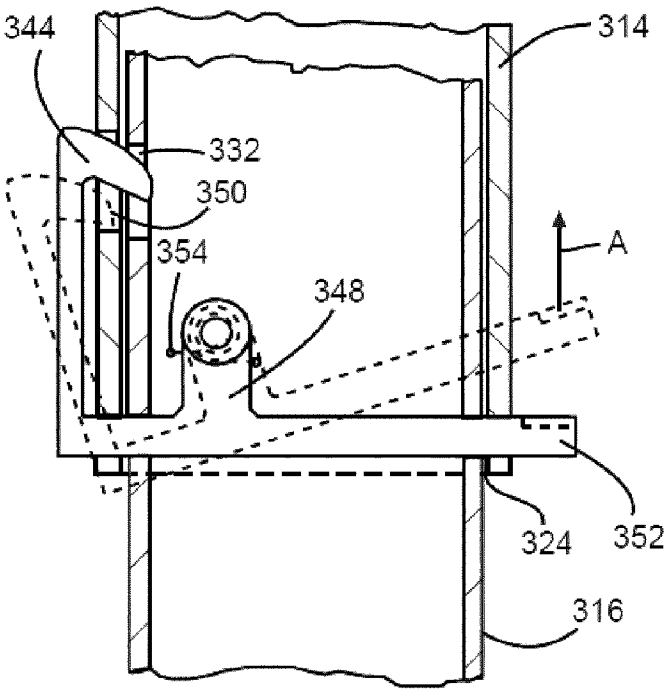
FIG. 10B is an enlarged view, in partial cross section, of the safety catch mechanism of FIG. 10A.
Figure 10A:
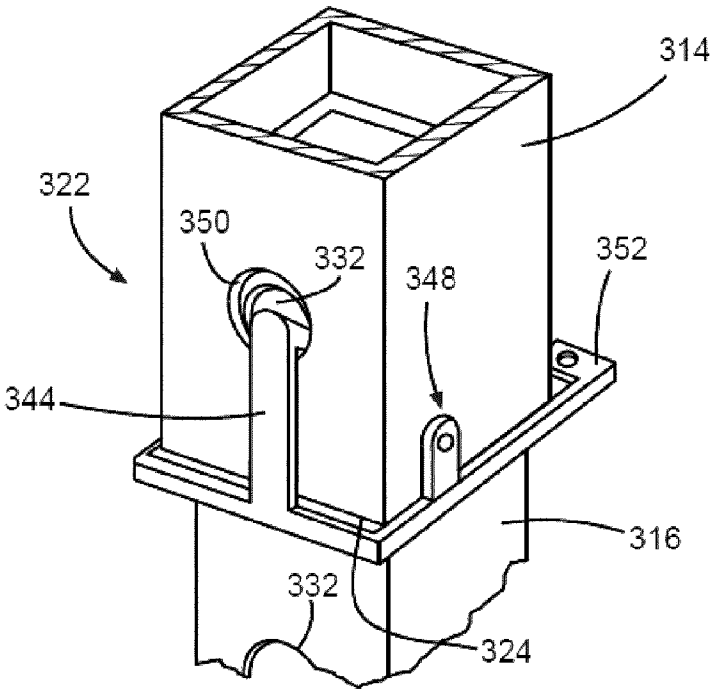
FIG. 10A is an enlarged, perspective view of a portion of the safety catch mechanism the stilt of FIG. 8.

As shown in FIGS. 10A and 10B, the latch 344 is pivotally supported on the outer tube 314 by a pair of hinges 348, though only one hinge 348 is shown. A portion of the latch 344 projects through a latching aperture 350, formed through part of the outer tube 314. A lever arm 352 connects one end of the latch rod 346 to the latch 344 and selectively pivots the latch 344 for engagement and disengagement with a desired one of the safety catch apertures 332. The latch rod 346 is connected at the other end to the release lever 342. When the release lever 342 is actuated to permit telescoping movement of the leg support 312, the latch rod 346 moves in the direction of Arrow "A" and rotates the latch arm 352 about the hinge 348. Rotation of the latch arm 352 causes the latch 344 to retract from the safety catch aperture 332. The latch 344 may remain in the latching aperture 350 when the safety catch assembly 322 is released, as shown in phantom in FIG. 10B, though such is not required. The latch 344 is biased into engagement with the safety catch aperture 332 by a resilient member, illustrated in FIG. 10B as a torsional coil spring 354. The resilient member may alternatively be a linear spring (not shown) connected between the latch arm 352 and the outer tube 314.

When the user wishes to vary the height of the stilt 300 up or down, he actuates the release lever 342 to release the safety catch assembly 322. Simultaneously or nearly so, the release lever 342 actuates the release valve 340 to unlock or otherwise release the gas spring 334 and permit relative movement of the outer and inner tubes 314 and 316. The gas spring 334, in one embodiment, is biased toward an extended position, similar to the extended position shown in FIGS. 2, 4, and 5 of the previous embodiment described above. When the gas spring 334 is biased toward the extended position, the user may raise the foot platform 318 by actuating the release lever and shifting his weight to the other stilt. The same process can be repeated for the other stilt, thus allowing the user to ratchet himself to a desired elevated height. The bias of the gas spring may be overcome by the user shifting his weight onto the foot platform 318 of the unlock or released stilt 300. The user's weight will telescope the outer tube 314 over the inner tube 312 and thus reduce the distance between the foot platform and the base plate 328.

Figure 11:
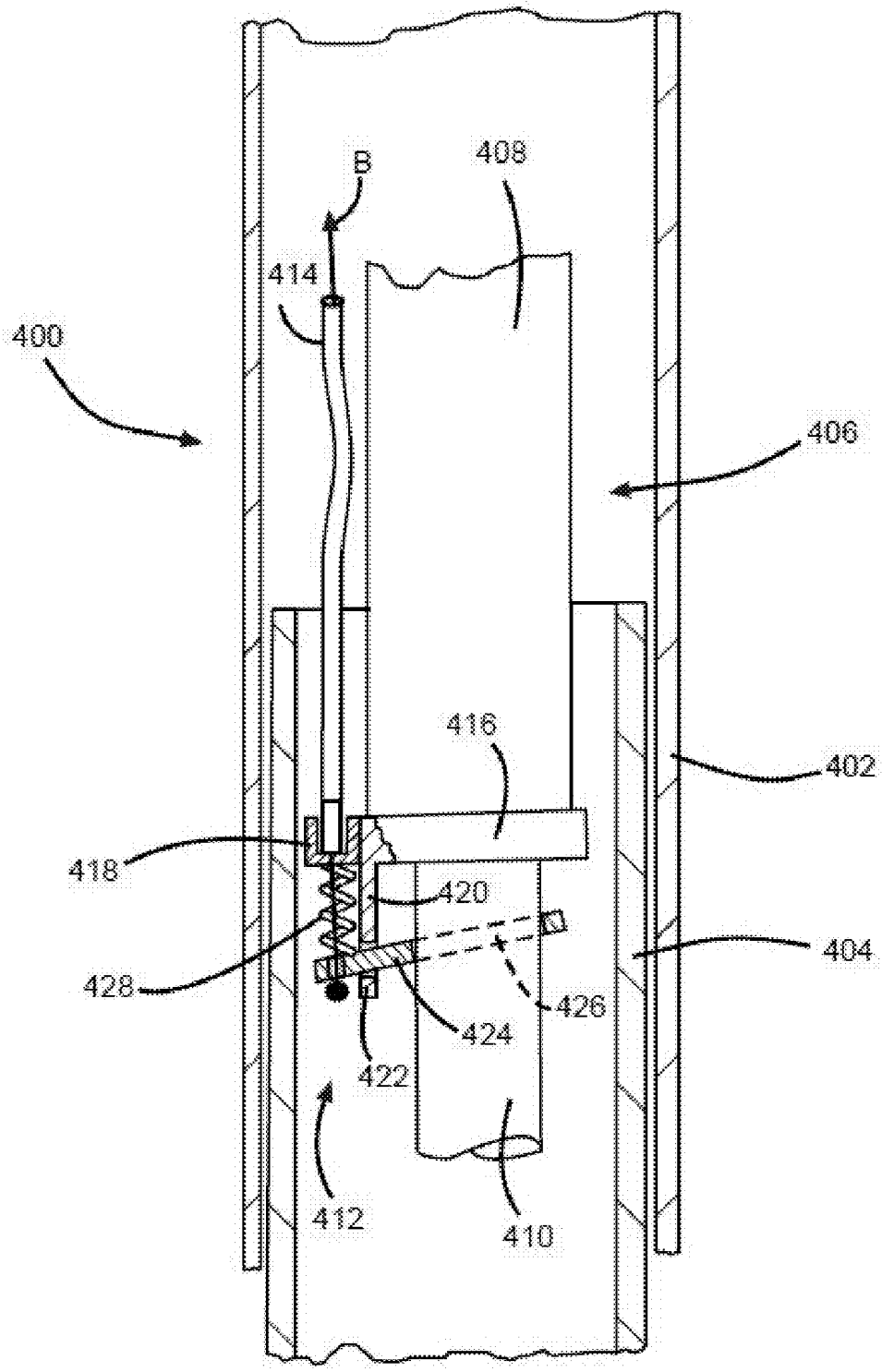
FIG. 11 is an enlarged view, in partial cross section, of a portion of a stilt mechanism having another embodiment of a safety catch mechanism.

Referring now to FIG. 11, there is illustrated a portion of a stilt 400 that includes an outer tube 402, an inner tube 404, and a gas spring assembly 406. The gas spring assembly 406 includes a cylinder 408 and a piston 410, similar to the embodiments described above. The stilt 400 includes another embodiment of a safety catch assembly, shown generally at 412. The safety catch assembly 412 is contained within the stilt 400 and may be actuated by a cable 414. A mounting collar 416 is shown connected to the cylinder 408. The mounting collar 416 includes a cable retainer 418 that supports an outer jacket or sheath of one end of the cable 414 in a generally fixed position relative to the mounting collar 416. The mounting collar 416 further includes a pivot leg 420 having a pivot aperture 422. A locking collar 424 includes a locking aperture 426 that engages the perimeter of the piston 410. The locking aperture 426 is sufficiently larger than the diameter of the piston 410 to allow relative movement therebetween.

The locking collar 424 pivots relative to the cylinder 408 which permits the locking aperture 426 to cock or otherwise make binding contact with the piston 410. A resilient member, such as a coil spring 428, biases the locking collar 424 into an engaged position with the piston 410 .movement of the cable, in the direction of arrow "B" aligns the locking aperture to be generally concentric with the piston 410 to unbind or permit movement between the piston 410 and the cylinder 408. This relative movement allows the outer and inner tubes 402 and 404 to telescope as described above.

Figure 12:
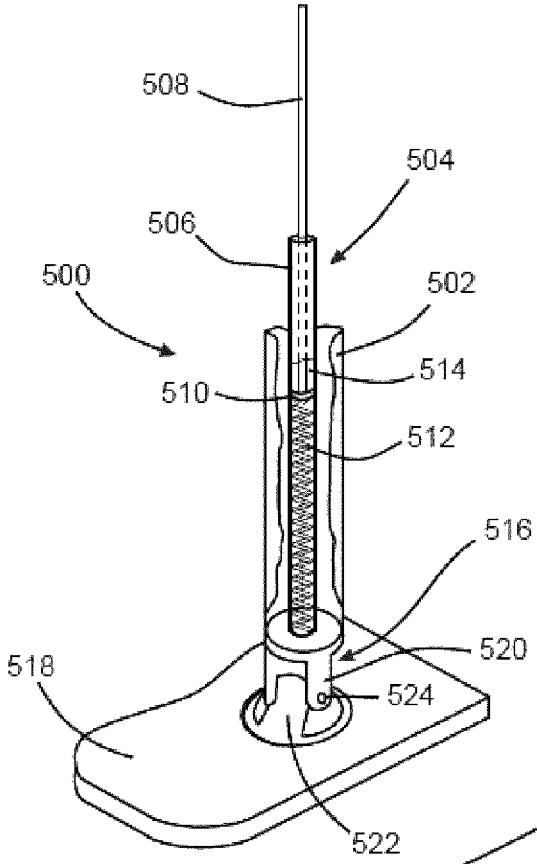
FIG. 12 is an enlarged perspective view, in partial cross section, of a portion of a stilt mechanism having another embodiment of a pivotable footplate connection.
Figure 13:
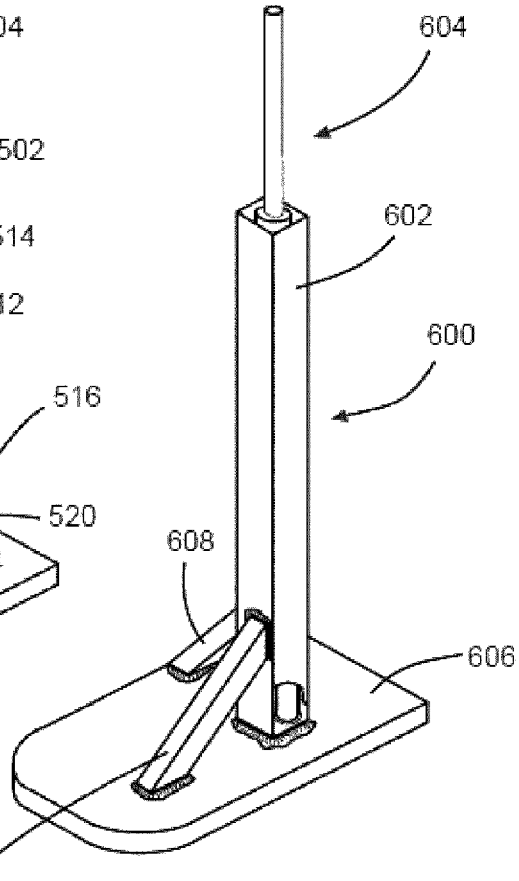
FIG. 13 is an enlarged perspective view of a portion of a stilt mechanism having another embodiment of a fixed footplate connection.

Referring now to FIGS. 12 and 13, there are illustrated alternative embodiments of base plate to stilt leg support attachments. These alternative attachments may be used with any of the stilt embodiments described herein, if desired. In the embodiment shown in FIG. 12, a lower portion of a stilt is shown generally at 500. The stilt 500 includes an outer tube (not shown), an inner tube 502, and a gas spring assembly 504. This particular embodiment of the gas spring assembly 504 includes a cylinder 506 and a piston 508 having a plunger end 510. A resilient member, such as a coil spring 512, is located between the plunger end and one end of the cylinder 506 near the bottom of the stilt, as shown. The gas spring 504 may be mounted in a reversed orientation to that shown in FIG. 12, where the spring 512 may be coaxially mounted around the piston and contained within the end of the cylinder 506, if desired. The spring 512 biases the gas spring 504 into an extended position, such as is described above. A fluid chamber 514, located on the opposite side of the plunger 510 fixes and releases relative movement of the piston 508 to permit telescopic movement of the stilt 500 as described above.

The stilt 500 includes a pivoting connection, shown generally at 516, between the inner tube 502 and a base plate 518. The pivoting connection 516 includes a first member, such as a yoke 520, connected to the end of the inner tube 502. A second member, such as a pivot flange 522, is connect to or formed integrally with the base plate 518. The yoke 520 is rotatably connected to the pivot flange 522 by a resilient bushing 524. The resilient bushing 524 biases the stilt 500 in a generally upright position, relative to a horizontal datum. The resilient bushing 524 allows the base plate 518 to flex or otherwise pivot in response to a user's gait. Alternatively, the resilient bushing 524 may be a pivot pin and may utilize the biasing springs 52 described above.

Referring now to FIG. 13, there is illustrated yet another embodiment of a stilt, shown generally at 600, having a fixed base plate. The stilt 600 includes similar components to the stilt embodiments described above. In particular, the stilt includes an inner tube 602 having a gas spring 604 disposed therein. The inner tube 602 is fixed to a base plate 606 by any suitable process or attachment device, such as welding, bolting, bonding, and the like. A first support leg 608 is shown oriented generally perpendicularly to a second support leg 610, though any relative orientation may be used. The first leg 608 assists in counteracting any bending loads onto the base plate 606 imparted by the user's weight shifting side to side. The second support leg counteracts bending loads imparted by the user's gait onto the base plate 606.

Some of the various embodiments described herein provide a stilt mechanism having a reduced entry and exit height. Other embodiments allow the stilt mechanism to be easily adjustable by the user during use. Some of these embodiments, in combination, provide a stilt mechanism that may allow a user to more easily put on the stilts and assume an elevated standing position. Additionally, some of the embodiments described herein provide a stable stilt structure that is self-standing. A self-standing characteristic provides stability by arranging the components of a stilt to substantially counteract statically-applied bending loads of the stilt components or the applied weight of the user without substantially relying on user-generated reaction forces.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A height adjustable stilt comprising:

a base;

an extensible leg having a lower end secured to the base and an upper end, the extensible leg including an outer tube connected to the base and further connected to a guide bar connector that carries the foot support, the outer tube adapted to telescopically receive an inner tube, the inner tube being connected to a cooperating guide bar such that telescopic movement of the inner tube relative to the outer tube causes height adjustment of a foot support relative to the base, the foot support extending laterally from and supported by the leg, the foot support being height adjustable relative to the base as the leg is extended or retracted; and a height adjuster configured to selectively extend the foot support relative to the base and configured to selectively fix the position of the foot support relative to the base.

2. The height adjustable stilt of claim 1 wherein a release lever is connected to the upper end of the extensible leg and operatively connected to the height adjuster such that the height adjuster extends the foot support relative to the base and the foot support can be urged toward the base.

3. The height adjustable stilt of claim 1 wherein the height adjuster is a gas spring.

4. The height adjustable stilt of claim 1 wherein the extensible leg includes an upper section and a lower section configured to be moved vertically relative to each other, the foot support being fixed to the upper section, and the height adjuster is configured to fix the upper section relative to the lower section.

5. The height adjustable stilt of claim 1 wherein the extensible leg is resiliently and pivotally secured to the base.

6. The height adjustable stilt of claim 1 wherein the extensible leg includes a safety catch assembly that is configured to prevent relative movement of the foot support relative to the base when the height adjuster ceases to selectively fix the position of the foot support relative to the base.

7. A height adjustable stilt comprising:

an outer tube having an open telescoping end and a foot platform attached adjacent to the open telescoping end;

an inner tube telescopically received within the outer tube at the open telescoping end;

a base plate connected to the inner tube; and a gas spring having a cylinder and a piston, the gas spring being disposed inside the telescopically engaged inner and outer tubes.

8. The height adjustable stilt of claim 7 wherein the distance between the foot platform and the base plate is less than the collapsed height of the outer tube and the inner tube.

9. The height adjustable stilt of claim 7 wherein a safety catch assembly is configured to selectively prevent relative movement of the foot platform relative to the base.

10. The height adjustable stilt of claim 9 wherein the safety catch assembly is configured as a secondary structure to selectively prevent relative movement of the outer tube to the inner tube and the gas spring is a primary structure to selectively prevent relative movement of the foot platform relative to the base.

11. The height adjustable stilt of claim 10 wherein the inner tube includes a plurality of safety catch apertures and the outer tube includes a safety catch assembly having a latch, the latch being operable to selectively engage one of the plurality of safety catch apertures.

12. The height adjustable stilt of claim 10 wherein the safety catch assembly includes a locking collar that is mounted onto the gas spring such that the locking collar prevents relative movement the piston relative to the cylinder.

13. The height adjustable stilt of claim 11 wherein a release lever is operatively connected to the latch and connected to a release valve of the gas spring such that actuation of the release lever simultaneously permits the latch and the release valve to allow relative movement of the outer tube and the inner tube.

14. The height adjustable stilt of claim 7 wherein the base plate includes a pivot flange that is pivotally coupled to a yoke by way of an elastomeric bushing, the yoke being connected to the inner tube.

15. The height adjustable stilt of claim 7 wherein the outer tube includes a leg support grip that moves relative to the inner tube, a release lever is connected to the outer tube and configured to allow selective telescopic movement of the outer tube relative to the inner tube, and the gas spring includes a release valve, the gas spring being connected to the outer tube such that the release valve is responsive to the release lever to permit telescopic movement of the foot platform relative to the base plate.

16. A height adjustable stilt comprising:

an inner tube telescopically received within an outer tube;

a base plate connected to one of the inner and the outer tube and a foot support connected to the other of the inner and the outer tube;

a height adjuster operatively connected to a release lever such that the height adjuster selectively allows the foot support to extend relative to the base plate and to be compressed toward the base when the release lever is actuated, the height adjuster further configured to fix the position of the foot support relative to the base plate when the release lever is released.

17. The height adjustable stilt of claim 16 wherein the collapsed distance of the foot platform to the base plate is less than the collapsed distance of the inner tube and the outer tube.

18. The height adjustable stilt of claim 16 wherein a safety catch assembly is operable to prevent relative telescopic movement of the outer tube and the inner tube when the gas spring is inoperative.

19. The height adjustable stilt of claim 15 wherein the foot platform includes a flexible sole plate.

* * * * *

UNITED STATES PATENT AND TRADEMARK OFFICE

CERTIFICATE OF CORRECTION

PATENT NO. : 7,794,366 B2
APPLICATION NO. : 12/547372
DATED : September 14, 2010
INVENTOR(S) : Kevin D. Smith and Patrick Chaney It is certified that error appears in the above-identified patent and that said Letters Patent is hereby corrected as shown below:

Column 10 Lines 45-48 Replace Claim 17 with the following:

17. A height adjustable stilt comprising:

an inner tube telescopically received within an outer tube;

a base plate connected to one of the inner and the outer tube and a guide bar connector configured to carry a foot support connected to the other of the inner and the outer tube;

a guide bar configured to cooperate with the guide bar connector such that telescopic movement of the inner tube relative to the outer tube causes height adjustment of the foot support relative to the base; and a height adjuster operatively connected to a release lever such that the height adjuster selectively allows the foot support to extend relative to the base plate and to be compressed toward the base when the release lever is actuated, the height adjuster further configured to fix the position of the foot support relative to the base plate when the release lever is released.

Signed and Sealed this
Twenty-eighth Day of December, 2010

David J. Kappos

David J. Kappos
*Director of the United States Patent and Trademark Office*